US011740589B2

(12) United States Patent
Janer et al.

(10) Patent No.: US 11,740,589 B2
(45) Date of Patent: Aug. 29, 2023

(54) MULTI-CAM, CONTINUOUS-DRIVE ESCAPEMENT MECHANISM

(71) Applicants: Werner Janer, Bridgeport, CT (US); Weiru Shao, Auburndale, MA (US)

(72) Inventors: Werner Janer, Bridgeport, CT (US); Weiru Shao, Auburndale, MA (US)

( * ) Notice: Subject to any disclaimer, the term of this patent is extended or adjusted under 35 U.S.C. 154(b) by 416 days.

(21) Appl. No.: 17/259,595

(22) PCT Filed: Jul. 18, 2019

(86) PCT No.: PCT/US2019/042475
§ 371 (c)(1),
(2) Date: Jan. 12, 2021

(87) PCT Pub. No.: WO2020/018838
PCT Pub. Date: Jan. 23, 2020

(65) Prior Publication Data

US 2021/0318659 A1 Oct. 14, 2021

Related U.S. Application Data

(60) Provisional application No. 62/700,604, filed on Jul. 19, 2018.

(51) Int. Cl.

| | |
|---|---|
| ***G04B 15/08*** | (2006.01) |
| ***G04B 13/02*** | (2006.01) |
| ***G04B 15/14*** | (2006.01) |

(52) U.S. Cl.
CPC ..... *G04B 15/08* (2013.01); *G04B 13/02* (2013.01); *G04B 15/14* (2013.01)

(58) Field of Classification Search
CPC ..... G04B 15/08; G04B 13/02; G04B 15/14
See application file for complete search history.

(56) References Cited

U.S. PATENT DOCUMENTS

| | | | | |
|---|---|---|---|---|
| 991,048 | A * | 5/1911 | Crank | G04B 15/08 968/99 |
| 1,232,285 | A * | 7/1917 | Greeley | G04B 15/00 968/95 |
| 2,542,178 | A | 2/1951 | Bishop | |
| 3,146,581 | A | 9/1964 | Garbe | |
| 3,670,493 | A * | 6/1972 | Wuthrich | G04B 15/12 74/1.5 |
| 7,661,874 | B2 | 2/2010 | Conus et al. | |

(Continued)

FOREIGN PATENT DOCUMENTS

| | | | |
|---|---|---|---|
| CH | 211976 | A * | 10/1940 |
| CH | 211976 | | 2/1941 |

*Primary Examiner* — Edwin A. Leon
*Assistant Examiner* — Kevin Andrew Johnston
(74) *Attorney, Agent, or Firm* — Douglas Denninger

(57) ABSTRACT

An escapement mechanism including a dual-forked lever having a pivot suitable for movement of the lever between a first pivot limit and a second pivot limit, and at least two rounded follower elements spaced from the pivot and at a predetermined distance from each other. At least one of the follower elements is mounted on each fork of the lever and each follower element lacks a locking face. At least one escape wheel has an outer periphery defining at least a first plurality of cam elements suitable to slidably contact and drive the rounded follower elements, and each cam element lacks a locking surface where contact is made with the follower elements.

15 Claims, 15 Drawing Sheets

(56) References Cited

U.S. PATENT DOCUMENTS

| | | | | |
|---|---|---|---|---|
| 2011/0235474 | A1* | 9/2011 | Wiederrecht | G04B 1/225 368/200 |
| 2011/0310709 | A1* | 12/2011 | Vaucher | G04B 15/08 368/127 |
| 2016/0170374 | A1* | 6/2016 | Monferrer | G04B 13/002 368/132 |

* cited by examiner

MULTI-CAM, CONTINUOUS-DRIVE ESCAPEMENT MECHANISM

CROSS-REFERENCE TO RELATED APPLICATION

This application claims priority to U.S. Provisional Application No. 62/700,604 filed on 19 Jul. 2018. The entire content of the above-mentioned application is incorporated herein by reference.

FIELD OF THE INVENTION

This invention relates to escapement mechanisms for mechanical drive systems.

BACKGROUND OF THE INVENTION

Various types of escapement mechanisms have been utilized in watches and clocks since at least the $13^{th}$ century to periodically transfer energy from a power source to a timekeeping assembly such as a pendulum or a balance wheel with torsion spring. Escapement mechanisms have also been utilized in other mechanical linkage systems such as in mechanical typewriters.

Mechanical escapements typically have an escape wheel defining a plurality of teeth that engage pallets on a lever. There is at least one type of known escapement utilizing two coaxial escape wheels. Virtually all escapements alternate between "locked" and "unlocked" states, which interrupts rotation of the escape wheel, increases wear of the escape wheel, and wastes drive energy from the power source. One such lever escapement is disclosed by Conus et al. in U.S. Pat. No. 7,661,874 B2, for example, having first and second locking pallet stones 12, 13 as well as impulse stones.

It is therefore desirable to have an improved, lower-friction escapement mechanism.

SUMMARY OF THE INVENTION

An object of the present invention is to provide a more efficient escapement mechanism which experiences reduced friction within the mechanism.

Another object of the present invention is to provide such an escapement mechanism which enables longer run time utilizing a given power source.

Yet another object of the present invention is to provide such an escapement mechanism which may be more durable, incur a lower cost to manufacture, and/or be more accurate over long durations of operation.

This invention results from the realization that a more efficient escapement mechanism can be made by selecting an escape wheel that interacts with rounded pallets on a lever in a sliding, cam-like manner without stopping rotation of the escape wheel when it is driven directly or indirectly by a power source, so that energy losses are reduced when power is transferred from the escape wheel to the lever.

This invention features an escapement mechanism including a dual-forked lever having a pivot suitable for movement of the lever between a first pivot limit and a second pivot limit, and at least two rounded follower elements spaced from the pivot and at a first predetermined distance from each other. At least one of the follower elements is mounted on each fork of the lever and each follower element lacks a locking face. The mechanism further includes at least one escape wheel having an outer periphery defining at least a first plurality of cam elements. Each cam element defines at least a leading cam surface suitable to slidably contact and drive the rounded follower elements, and each cam element lacks a locking surface where contact is made with the follower elements.

In some embodiments, each of the cam elements is a rounded lobe. In certain embodiments, the escapement mechanism further includes at least two limiter elements, with one of the at least two limiter elements being fixed on one pivot side of the lever to establish the first pivot limit and the other of the at least two limiter elements being fixed on another side of the lever to establish the second pivot limit, and the at least two limiter elements limiting rotation of the lever about its pivot. In one embodiment, the limiter elements are banking pins mounted on a support structure.

In a number of embodiments, the at least a first plurality of cam lobes are arcuately-spaced curved elements, each of which defines leading and trailing cam surfaces. In one embodiment, the at least a first plurality of cam elements are rounded lobes that are evenly spaced from each other about the periphery of the at least one escape wheel and are suitable to isochronally and slidably contact and drive the rounded follower elements. In certain embodiments, the at least a first plurality of cam lobes are each spaced at a second predetermined distance from each other, with the first predetermined distance being a multiple of the second predetermined distance. In one embodiment, each fork carries at least one jewel as the at least one follower element, and the forks are symmetrical to each other and, in another embodiment, the forks are asymmetrical to each other.

In certain embodiments, the first plurality of cam elements slidably contacts and drives the at least one follower element on one of the two forks of the lever, and a second escape wheel, disposed coaxially with the first escape wheel, defines a second plurality of cam elements. Each cam element of the second plurality of cam elements defines a leading cam surface suitable to slidably contact and drive the at least one rounded follower element on the other of the two forks, and each cam element lacks a locking surface where contact is made with the follower elements. In one embodiment, the at least a first plurality of cam lobes and the second plurality of cam lobes are spaced at a second predetermined distance from each other, with the first distance between the at least two follow elements being a multiple of the second predetermined distance. In some embodiments, one of the first and second escape wheels has a smaller diameter than the other of the escape wheels.

In one embodiment, the at least two follower elements differ in at least one dimension from each other, such as thickness and/or diameter. In some embodiments, the lever transfers drive power to a time-keeping assembly such as a balance wheel with torsion spring. In a number of embodiments, the escapement mechanism is part of a mechanical linkage including a first gear train suitable to drive the at least a first escape wheel.

This invention may also be expressed as a method of driving a time-keeping assembly, including selecting an escapement mechanism having (i) a dual-forked lever with a pivot suitable for movement of the lever between a first pivot limit and a second pivot limit, and at least two rounded follower elements spaced from the pivot and spaced at a first predetermined distance from each other, with at least one follower element mounted on each fork of the lever and each follower element lacking a locking face, and (ii) at least one escape wheel having an outer periphery defining at least a first plurality of cam elements, each cam element defining a leading cam surface suitable to slidably contact and drive the rounded follower elements, and each cam element lacks a locking surface where contact is made with the follower elements. The method further includes providing power to drive the at least one escape wheel continuously in one rotational direction, and transferring power from the at least one escape wheel to the lever to move the lever between the first pivot limit and the second pivot limit and thereby drive the time-keeping assembly.

BRIEF DESCRIPTION OF THE DRAWINGS

In what follows, preferred embodiments of the invention are explained in more detail with reference to the drawings, in which.

DETAILED DESCRIPTION OF THE PRESENTLY PREFERRED EMBODIMENTS

This invention may be accomplished by an escapement mechanism including a dual-forked lever having a pivot suitable for movement of the lever between a first pivot limit and a second pivot limit. At least two rounded follower elements, such as rounded jewels, are spaced from the pivot and at a predetermined distance from each other. At least one of the follower elements is mounted on each fork of the lever, and each follower element lacks a locking face. The escapement mechanism further includes at least one escape wheel having an outer periphery defining a plurality of cam elements, such as arcuately-spaced curved cam lobes, suitable to slidably contact and drive the rounded follower elements. Each cam element lacks a locking surface where contact is made with the follower elements.

The term "escape wheel" as utilized herein includes a gear having multiple curved, lobe-like cams serving as "cam elements" protruding radially from a disk. Alternatively, although less preferably, the cam elements are teeth with sharp points similar to a shark's tooth or other triangular shape. In all constructions, each cam element lacks a locking surface where contact is made with one or more follower elements.

The term "rounded" as utilized herein refers to a curved surface which lacks a planar face wherever contact is to be made between a follower element of a lever and cam elements of an escape wheel.

The term "follower element" as utilized herein includes stones such as jewels and/or metallic structures including cylinders such as pins, wherein each follower element lacks a locking face wherever contact is to be made with cam elements on an escape wheel.

The terms "continuous", "continuous-drive" and "continuously in one rotational direction" refer to rotation of at least one escape wheel, during operation of an escapement mechanism according to the present invention, without stopping the rotation of that escape wheel of the escapement mechanism. In other words, the escape wheel is not periodically "locked" or "stepped" by any element during operation.

The term "substantially" as utilized herein encompasses deviations of up to ten percent of a parameter.

Figure 1C:
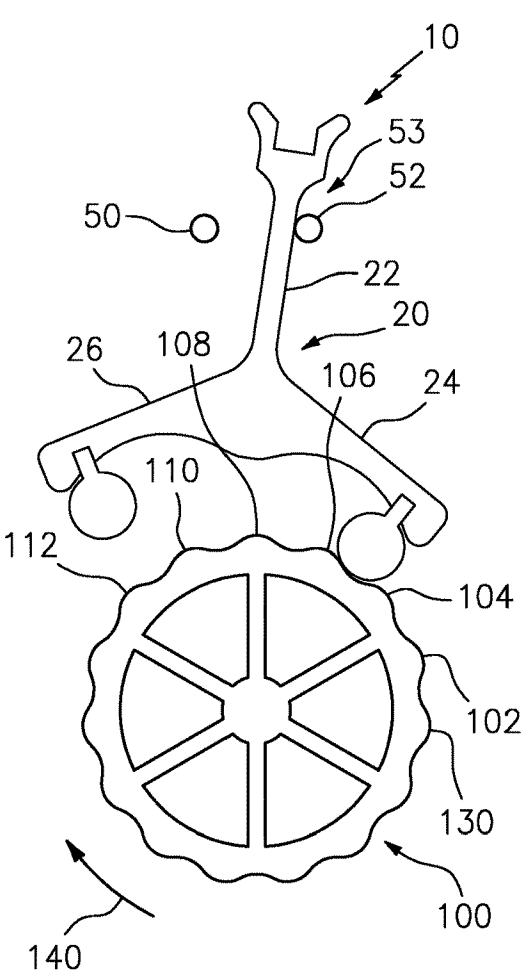
FIG. 1A-1C are schematic side views of one embodiment of an escapement mechanism according to the present invention showing a lever driven (A) to the right, (B) centered, and (C) to the left, respectively, by an escape wheel.
Figure 1B:
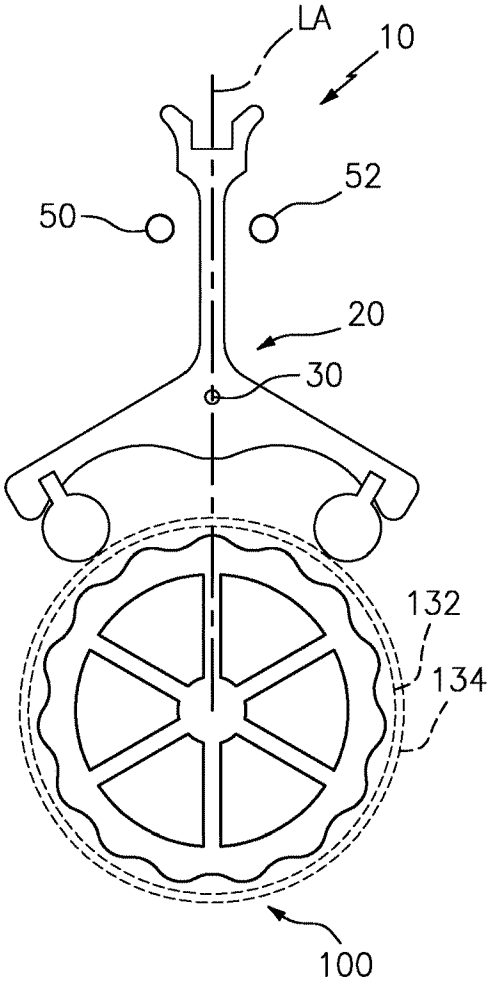
Figure 1A:
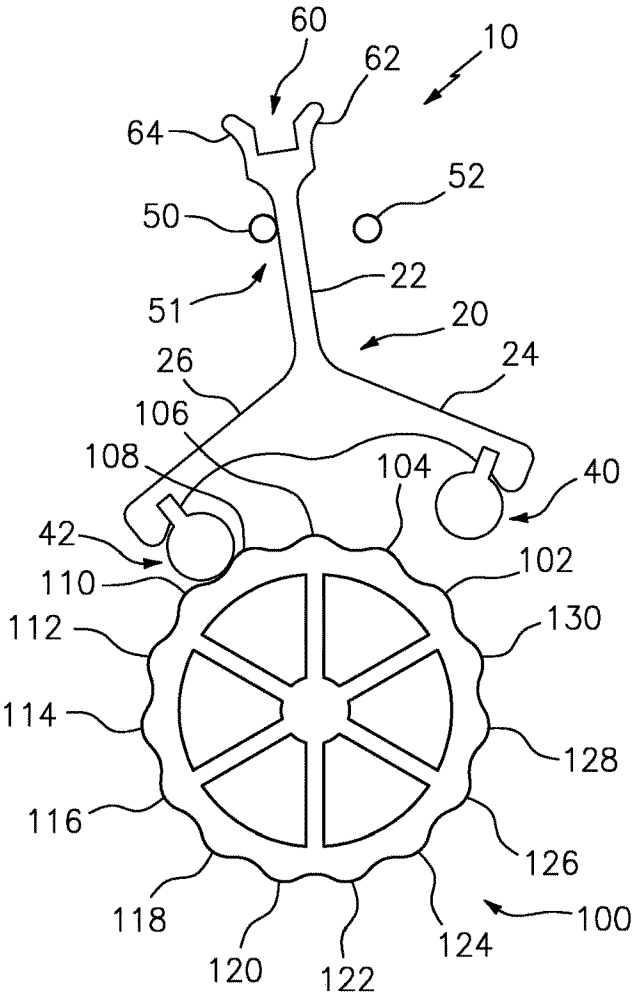

An escapement mechanism 10 according to the present invention, FIGS. 1A-1C, includes a lever 20 driven to the right, centered, and to the left, respectively, by an escape wheel 100 which rotates clockwise in this construction as indicated by arrow 140. Lever 20 has a primary shaft 22, a right fork 24 and a left fork 26 which carry follower elements 40 and 42, respectively. Lever 20 further defines a pivot 30 which, in this construction, is disposed along a longitudinal axis LA as illustrated in FIG. 1B.

Figure 1D:
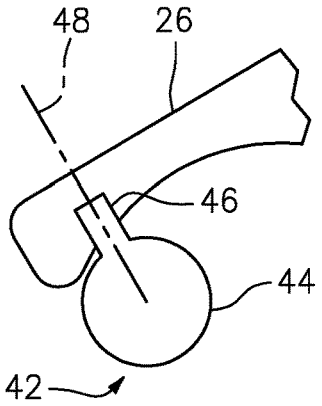
FIG. 1D is a schematic enlarged view of one of the follower elements of FIGS. 1A-1C.

Follower element 42 is shown enlarged in FIG. 1D having a rounded contact surface 44 and a mounting element 46 which is fixedly attached to fork 26. Dashed line 48 indicates a centreline passing through the mounting element 46. In one construction, follower elements 40, 42 are disks that are rounded in length and width, such as shown schematically in FIG. 2B for similar follower elements 40*a*, 42*a*. In another construction, are substantially spherical, that is, are rounded in three dimensions.

Escapement mechanism 10, FIGS. 1A-1C, further includes at least two limiter elements 50 and 52, with limiter element 50 being fixed on one pivot side of the lever to establish a first pivot limit 51 as shown in FIG. 1A being approached by the left side of the shaft 22 of lever 20, and the other limiter element 52 being fixed on another side of the lever to establish the second pivot limit 53 as illustrated in FIG. 1C being approached by the right side of the shaft 22 of lever 20, such that the two limiter elements 50, 52 limiting rotation of the lever 20 about its pivot 30 to establish its extremes of rotation. In this construction, the limiter elements 50, 52 are banking pins mounted on a support structure (not shown). Also in this construction, lever 20 includes a balance wheel engagement element 60 having tangs 62 and 64. Engagement element 60 may also be referred to as a forked element which engages a roller jewel of a balance wheel assembly in some constructions.

Escape wheel 100 defines fifteen cam elements 102, 104, 106, . . . 130 disposed evenly about the periphery of wheel 100 in this construction. A first broken circle 132, FIG. 1B, indicates the tops, crests or peaks of cam elements 102-130 while a second broken circle 134 indicates the clearance of follower elements 40, 42 in the central position of FIG. 1B relative to first circle 132.

Escape mechanism 10 as illustrated in FIGS. 1A-1D represents some extremes of designs according to the present invention. For example, when a follower element is equidistant between two crests, such as follower element 42 shown between crests of cam lobes 110 and 108 in FIG. 1A and follower element 40 shown between crests of lobes 106, 104 in FIG. 1C, it is generally preferred that the follower elements not contact the "valley" between each crest and/or that a side of shaft 22 of lever 20 not actually contact its respective limiter 50 or 52. If the limiters 50 and 52 are separated slightly farther apart, then the follower will leave the valley before the shaft 22 actually contacts the limiter 50 or 52. As described in more detail below, there are several techniques to optimize operation of escape mechanisms according to the present invention, including altering the "depth" and/or curvature of the follower element relative to the crests and valleys of the escape wheel.

Figure 2C:
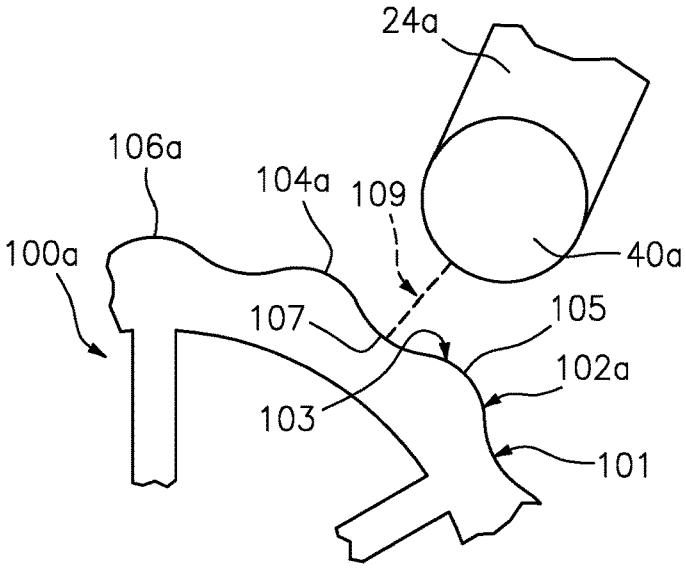
FIG. 2C is a schematic enlarged view of a portion of FIG. 2A.
Figure 4A:
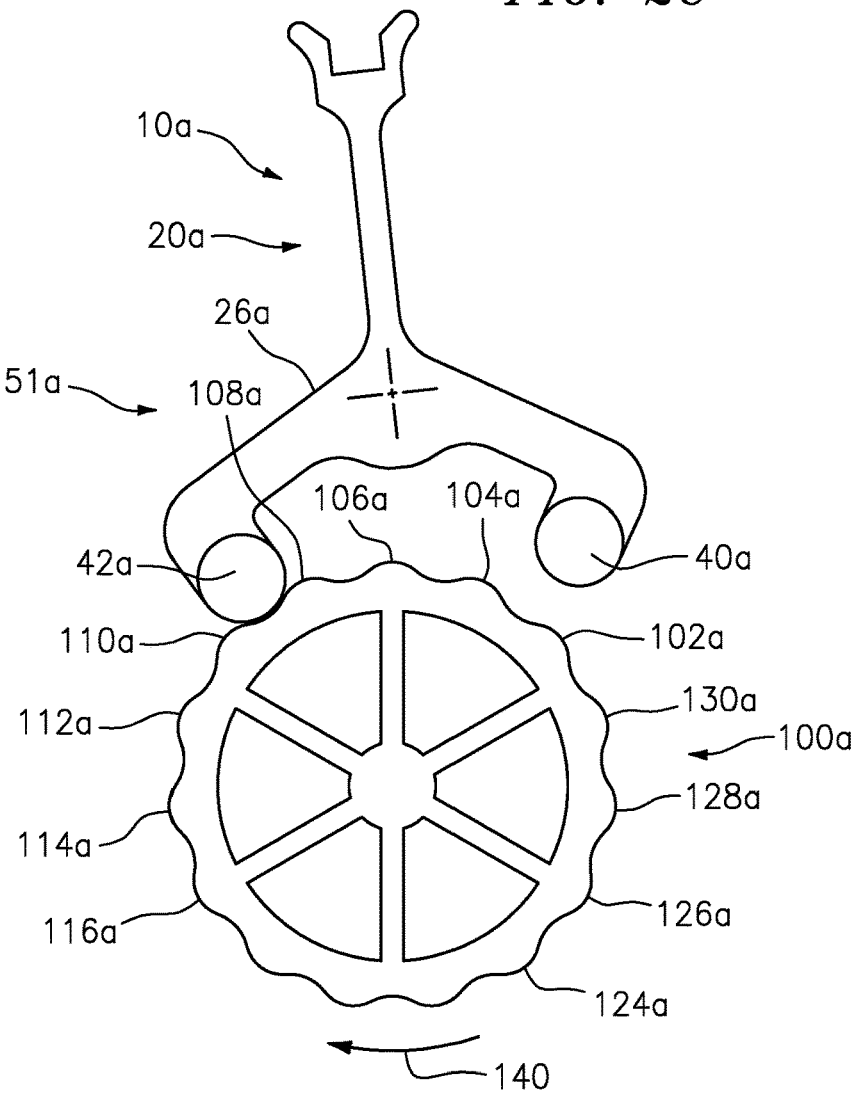
FIGS. 4A-4K schematically illustrate successive positions of the escapement mechanism of FIG. 2A over time.
Figure 2B:
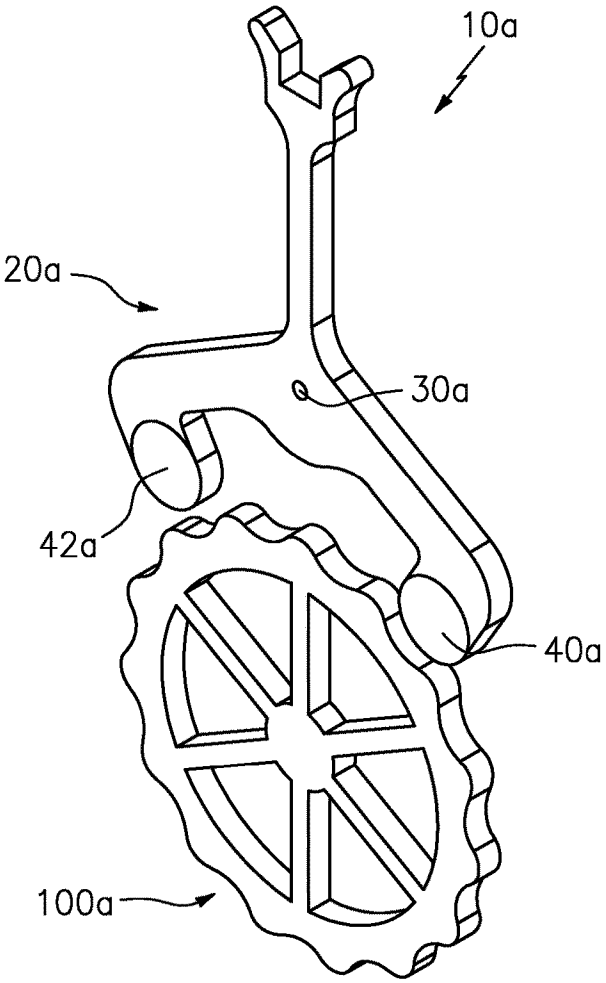
FIGS. 2A and 2B are schematic side and perspective views, respectively, of an embodiment of the present invention that is similar to the escapement mechanism of FIGS. 1A-1C.
Figure 2A:
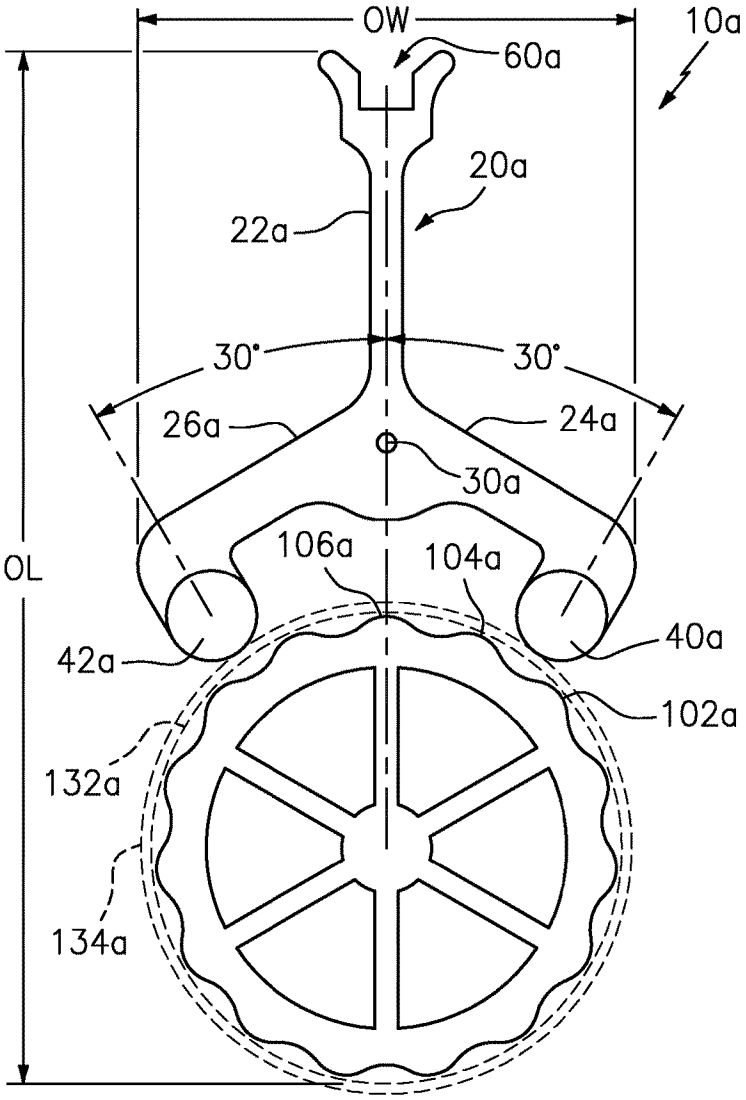

Escape mechanism 10*a* according to the present invention, FIGS. 2A-2B, is similar to the escapement mechanism 10 of FIGS. 1A-1D, but with reduced height differential between the crests and valleys of escape wheel 100*a*. Rounded follower jewel elements 40*a*, 42*a* are spaced from the pivot 30*a* and are spaced on forks 24*a*, 26*a* at a first predetermined distance from each other. The second predetermined distance is measured as a linear distance between the center of each follower in some constructions.

In one construction, dimensions for escape mechanism 10*a*, FIGS. 2A-2C, include an overall length OL of 11.6 mm (0.457 inch), and an overall width OW of 5.62 mm (0.221 inch). In one construction, an outer clearance circle 134*a*, which touches the lower (outermost) surfaces of jewels 40*a* and 42*a* when lever 20*a* is in a centered position, is 5.72 mm (0.225 inch) and the crests of the escape wheel cam lobes are within a circle 132*a* of 5.41 mm (0.213 inch). Escape wheels according to the present invention utilized in watches typically will vary from 4 mm to 5 mm (0.15 to 0.20 inch) in size; 5 mm is generally considered to be a fairly large wheel for a watch mechanism. The diameter of the escape wheel is typically 4.2 mm to 4.4 mm (0.165 to 0.123 inch). Follower elements 40*a*, 42*a* are preferably greater in width than the thickness of escape wheel 100*a* to accommodate vibrations and other potential sources of mis-alignment, more preferably at least 1.5 times greater (150% of the escape wheel width), and in some constructions, up to three times (up to 300%) greater in thickness than that of the escape wheel.

As illustrated in FIGS. 2A-2B, the cam elements 102*a*-130*a* are rounded lobes that are evenly spaced from each other about the periphery of the escape wheel 100*a* and are suitable to isochronally and slidably contact and drive the rounded follower elements 40*a*, 42*a*. In this construction, the cam lobes 102*a*-130*a* are each spaced at a second predetermined distance from each other. The second predetermined distance is measured as a linear "chord" in some constructions and, in other constructions, is an arcuate measurement such as distance along the circumference of the escape wheel and/or a specified number of degrees (such as twenty-four degrees spacing among each of fifteen cams or 17.14 degrees among twenty-one cams).

FIG. 2C is a schematic enlarged view of a portion of FIG. 2A showing a leading surface 101, leading up to a crest 105, and a trailing surface 103, oriented down toward a valley 107, of cam element 102*a*. The leading and the trailing surfaces 101, 103 have the same curvature in one construction and, in another construction, have curvatures that differ from each other. A dashed line 109 extends from the valley 107 to the closest surface of follower element 40*a* illustrating a gap between escape wheel 100*a* and follower element 40*a* for the position of escapement mechanism 10*a* illustrated in FIG. 2A In some constructions, the at least two follower elements 40*a*, 42*a* differ in at least one dimension from each other, such as thickness and/or diameter, and/or differ in composition, such as being different precious stones or other minerals, ceramics, and/or metals or metallic alloys.

Figure 3:
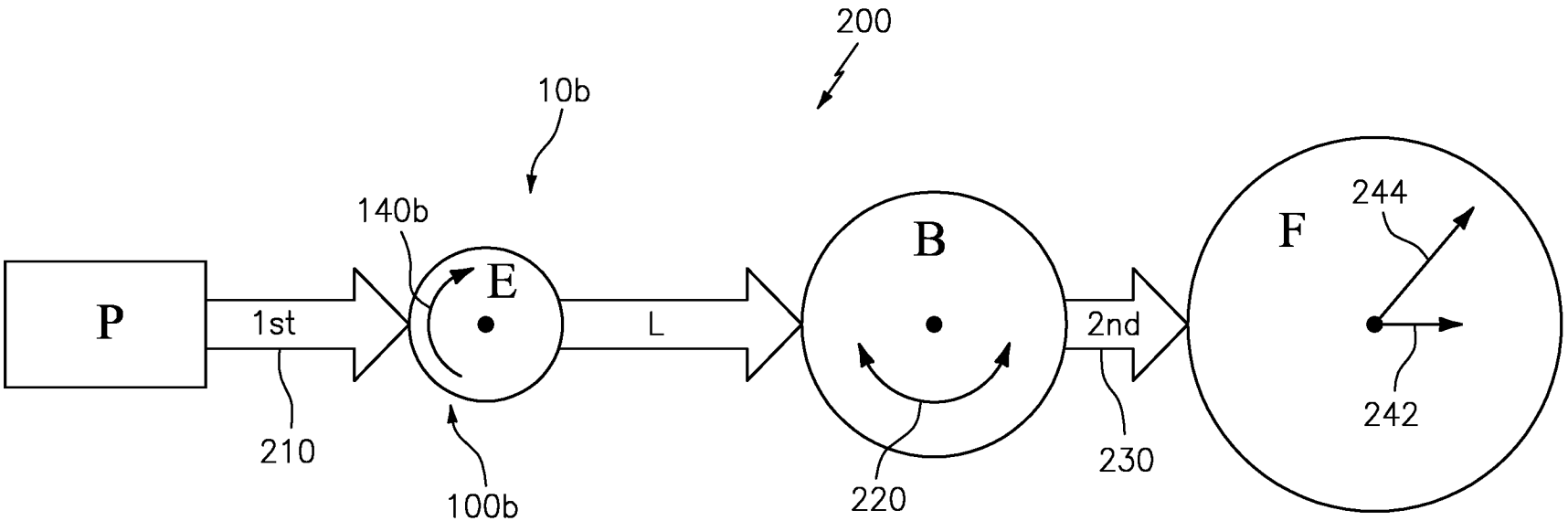
FIG. 3 is a schematic diagram of a time-keeping mechanism utilizing an escapement mechanism according to the present invention.
Figure 4B:
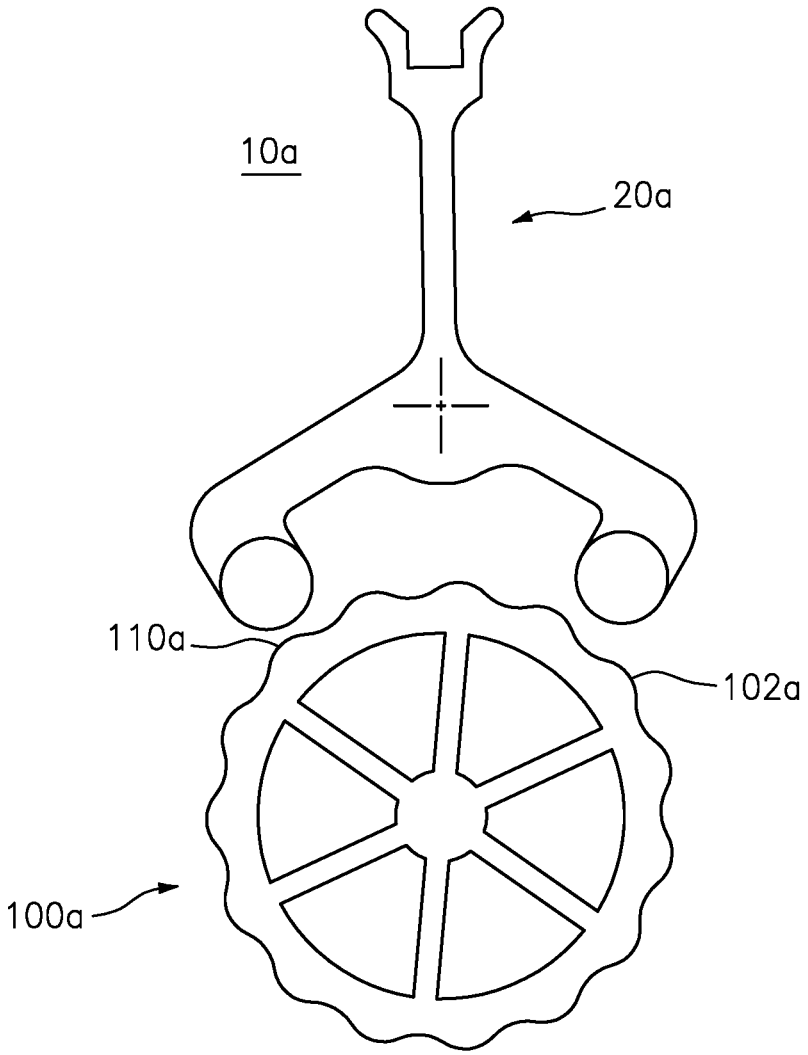
Figure 4C:
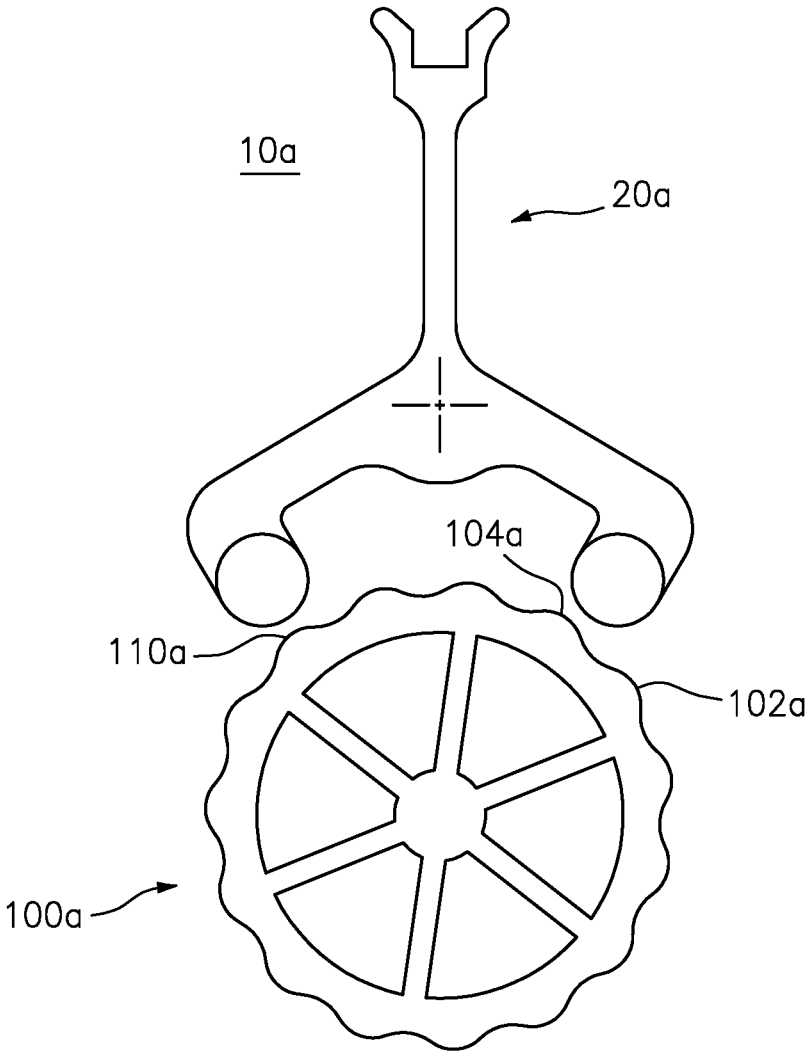
Figure 4D:
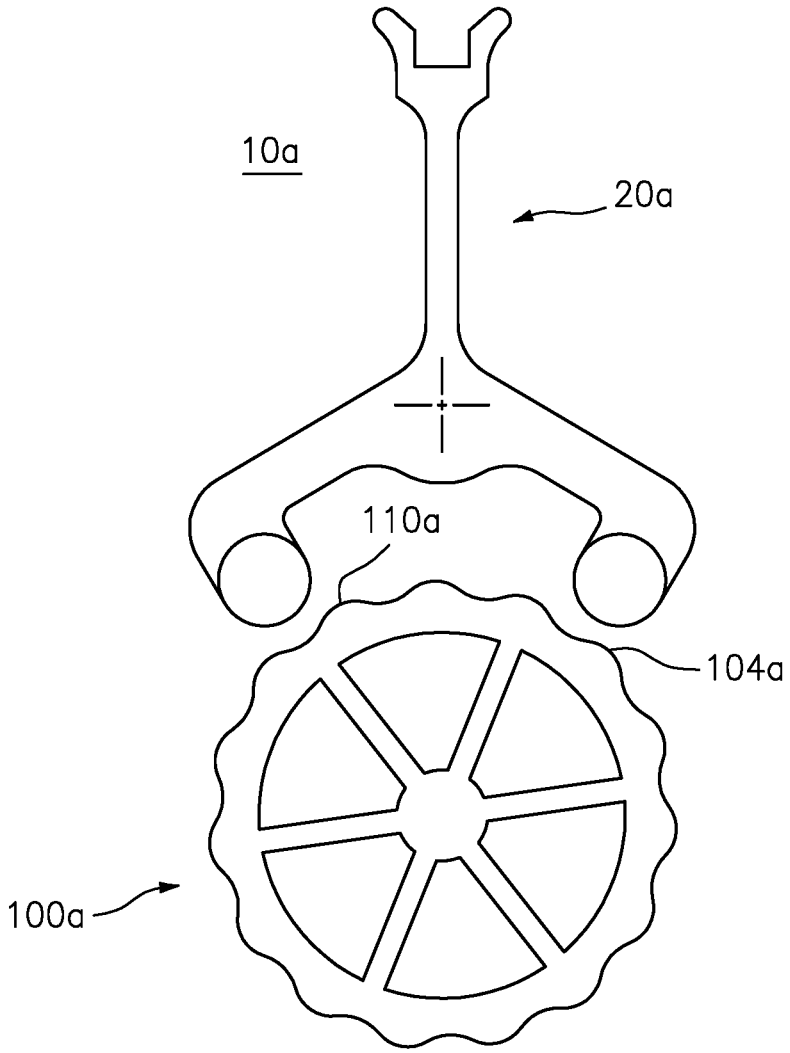
Figure 4E:
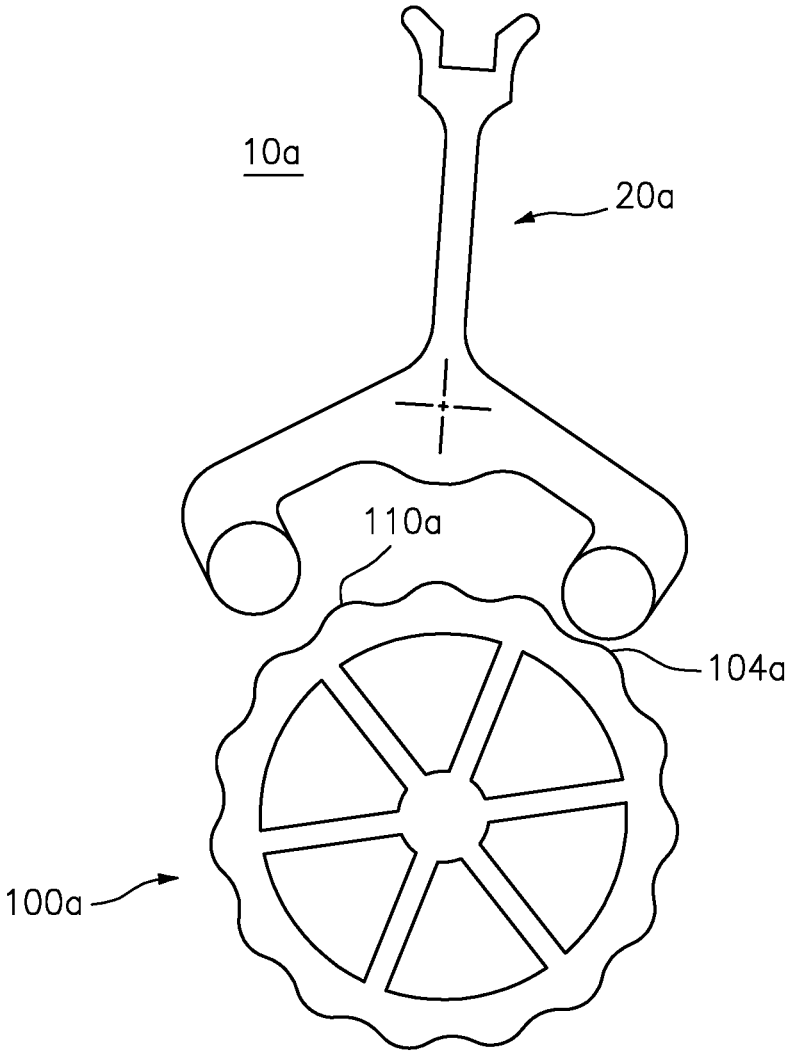
Figure 4F:
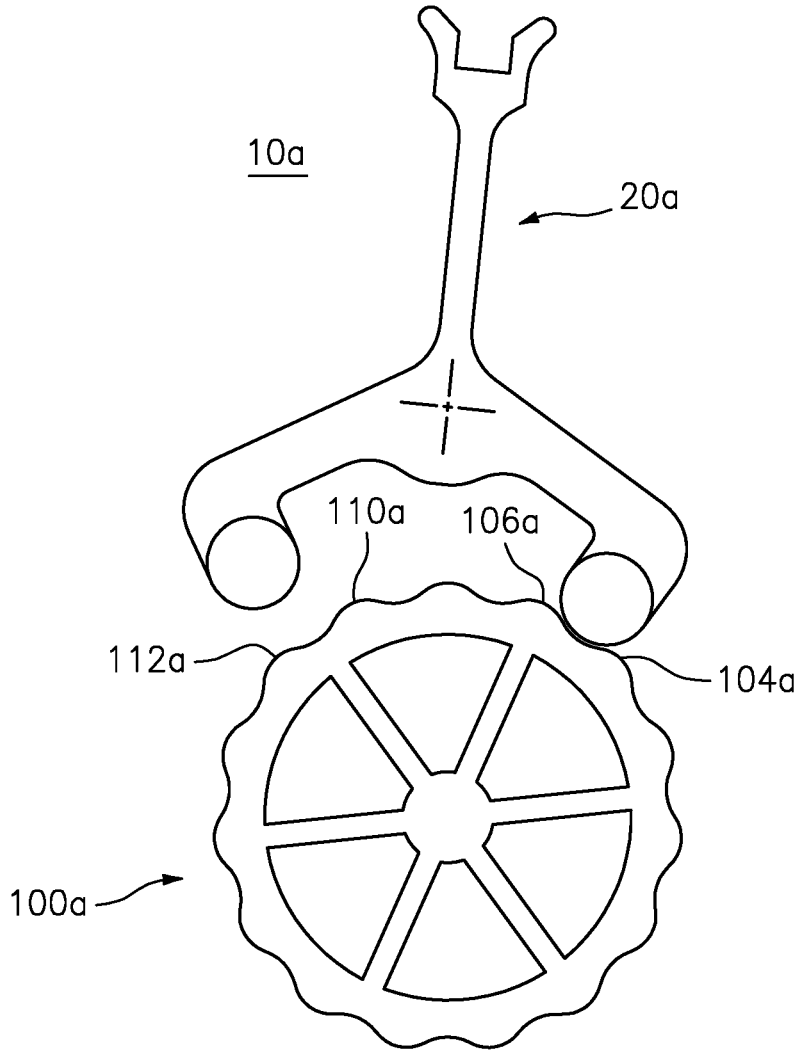
Figure 4G:
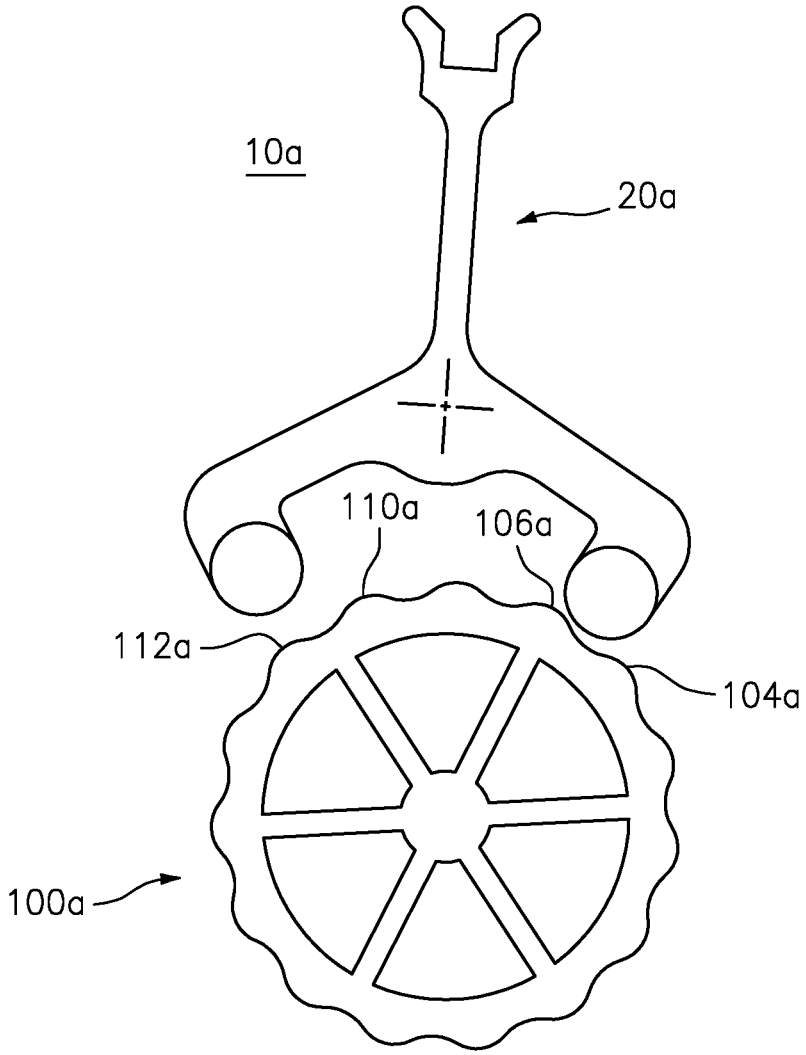
Figure 4H:
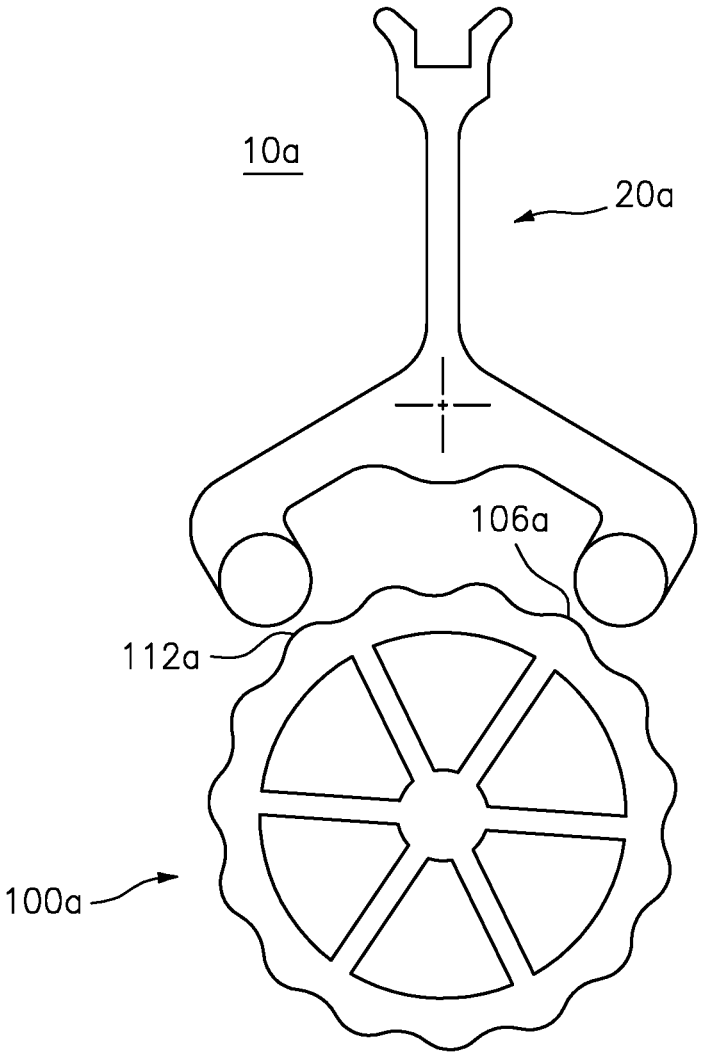
Figure 4I:
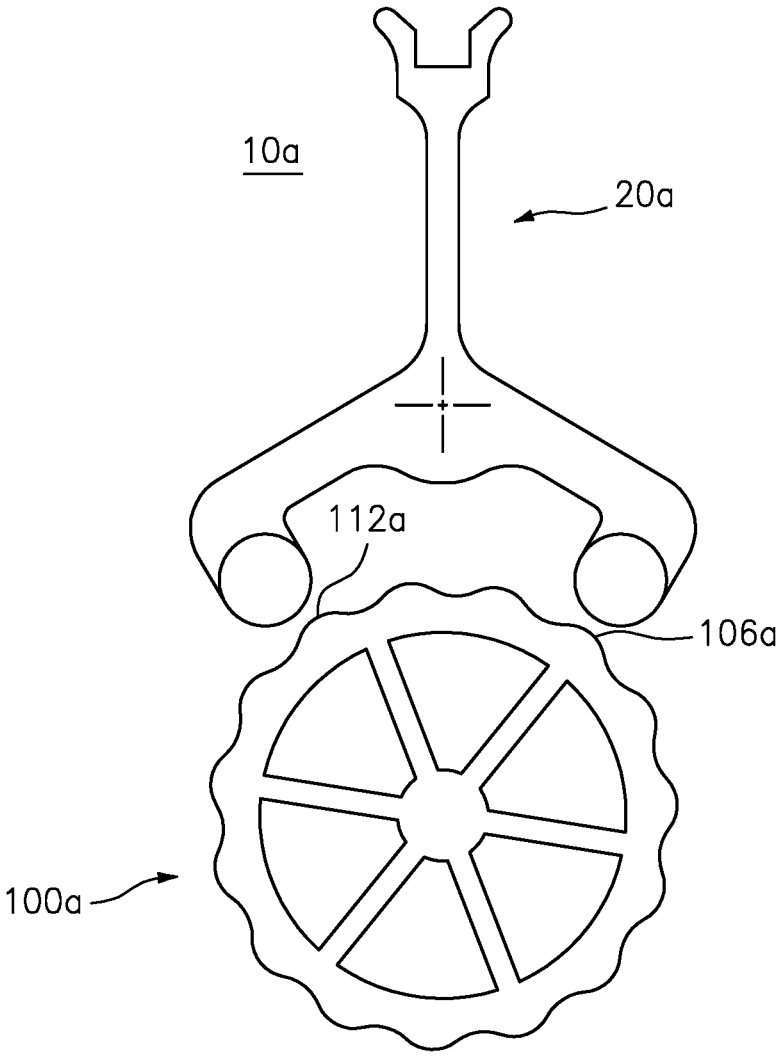
Figure 4J:
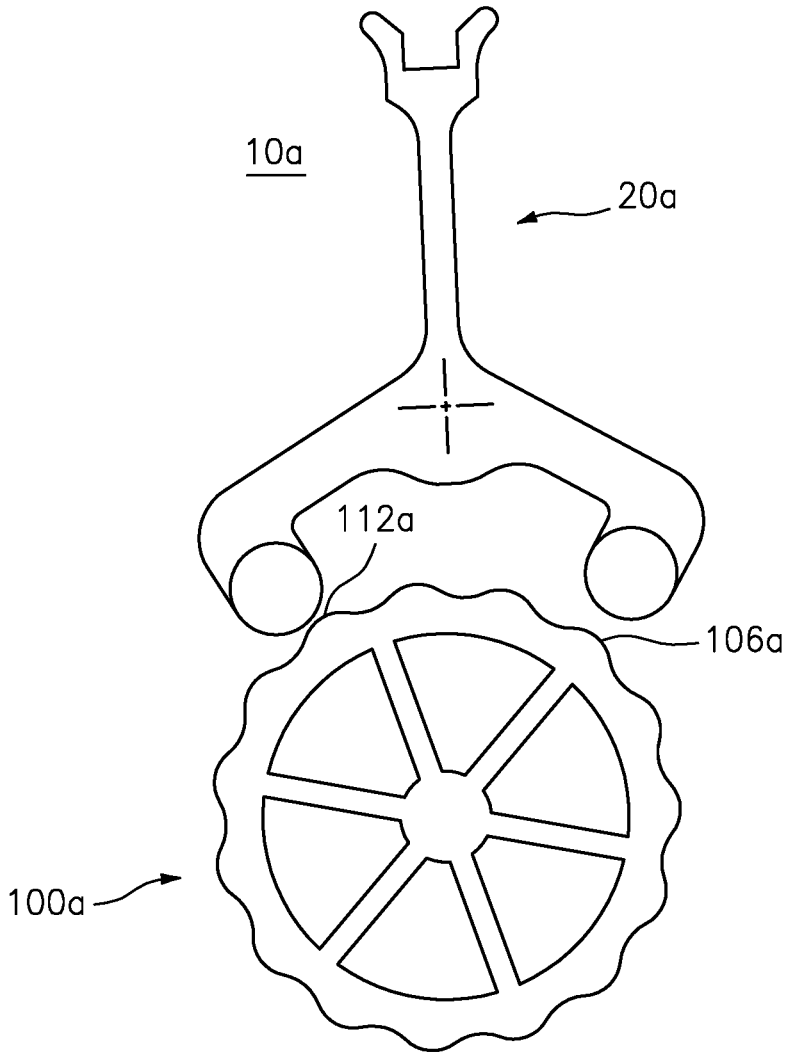
Figure 4K:
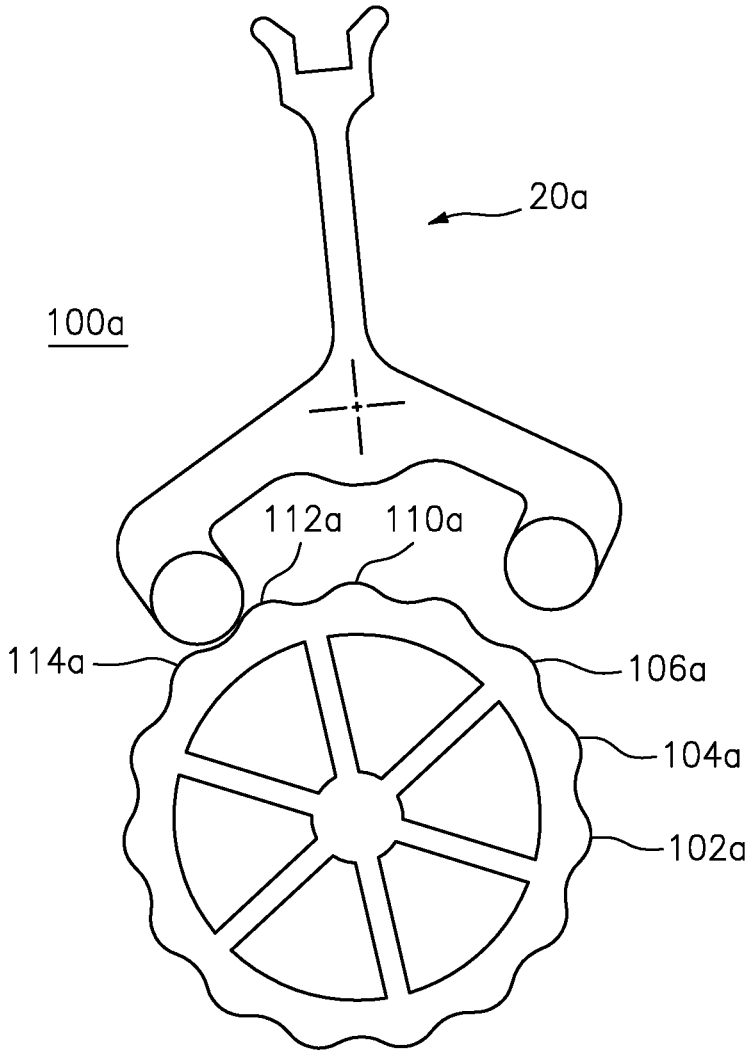

FIG. 3 is a schematic diagram of a time-keeping mechanism 200 utilizing an escapement mechanism 10*b* according to the present invention having escape wheel E and lever L having at least two follower jewels. A power source P includes a battery in some constructions and, in other constructions, includes a manually wound spring and/or a self-winding spring as is known in the time-keeping art. First gear train 210 transfers power from the power source P to the escape wheel E, also labelled as wheel 100*b*, which is thereby driven in a clockwise direction 140*b* in this construction. Balance wheel assembly B includes a torsional spring (not shown) and is driven by Lever L of the escapement mechanism 10*b* in alternating directions as shown by double-headed arrow 220. In some constructions, an engagement element on the lever L engages a roller jewel of the balance wheel assembly B to assist reversal of the movement of the lever L. This alternating motion of the balance wheel assembly B drives a second gear train 230 which advances an hour hand 242 and a minute hand 244 positioned above a time-piece face F as is known in the time-keeping art.

There are several parameters that can be adjusted to optimize performance of escape mechanisms according to the present invention. For example, the radius (curvature) at the bottom of each valley between crests may be greater than that of the follower jewel but not less than the radius of each crest. The actual radius at the crest of each cam is not critical in so far as the crest does not have an active contact with the follower jewel. Each leading cam surface, having a selected radius, is the impulse surface for the follower jewel, with torque supplied to the escape wheel from the powered first gear train; this selected radius may match the radius of the follower jewel. If the radius of the leading cam surface is too great it will contribute to a longer friction sliding engagement with the follower jewel. Preferably, the follower jewel is sufficiently small, for example, a 0.4 mm diameter jewel or smaller, to receive a sliding impulse draw from the leading surface of each passing escape cam lobe. The radius or shape of the trailing cam surface is not critical as it does not contact the follower jewel in most constructions of the present invention.

The critical depth of the follower jewel to the cam valley must be such that the jewel does not contact the valley between any two cams. This would add friction, and possibly stop the overall time-keeping mechanism. The second critical depth of the jewel is such that the jewel enters the valley deep enough to receive an impulse but not so shallow that the cam would pass without impulse contact; if the jewel were to pass a cam it would likely cause a condition known as "skipping", which is to be avoided. The distance at center between the two jewels may be adjusted by gently bending the fork arms with tweezers or by tapping in the staking anvil. The depth of the jewels may be adjusted by heating shellac and moving the jewel to the desired position and letting the shellac to cool and set.

In one construction, a permanent assembly of the radial jeweled lever comprises two horizontally slotted end fork arms, each with a matching radius at the back of the horizontal slot. The respective jewel would be inserted to its seat and affixed with shellac applied to a vertical hole in the slotted seat sufficient to allow the shellac to seep and hold the jewel. For example, the fork slot allows for a permanent installation of the jewel without need for adjustment. In some constructions, die stamping of the escape wheel with final geometry allows for permanence without the need for adjustment. The use of modern mechanical movements with fixed banking pins built into the body of the pallet bridge lends permanence to banking pin positioning.

FIGS. 4A-4K schematically illustrate successive positions of the escapement mechanism of FIG. 2A over time as escape wheel 100*a* is driven in the clockwise direction of arrow 140. Lever 20*a* is shown near a first pivot limit position 51*a* in FIGS. 4A and 4K, in a center position in FIGS. 4C and 4I, and in a second pivot limit position in FIG. 4F.

Broadly, FIGS. 4A-4K illustrate a method of driving a time-keeping assembly, including selecting an escapement mechanism 10*a* having (i) a dual-forked lever 20*a* with a pivot suitable for movement of the lever between a first pivot limit 51*a* and a second pivot limit 53*a*, and at least two rounded follower elements 40*a*, 42*a* spaced from the pivot and spaced at a first predetermined distance from each other. The escape wheel 100*a* has an outer periphery defining at least a first plurality of cam elements 102*a*-130*a*, each cam element defining a leading cam surface suitable to slidably contact and drive the rounded follower elements 40*a*, 42*a*. Each cam element lacks a locking surface where contact is made with the follower elements 40*a*, 42*a*. The method further includes providing power to drive escape wheel 100*a* continuously in one rotational direction 140, and transferring power from the at least one escape wheel 100*a* to the lever 20*a* to move the lever between the first pivot limit 51*a* and the second pivot limit 53*a* and thereby drive a time-keeping assembly such as illustrated in FIG. 3.

Figure 5:
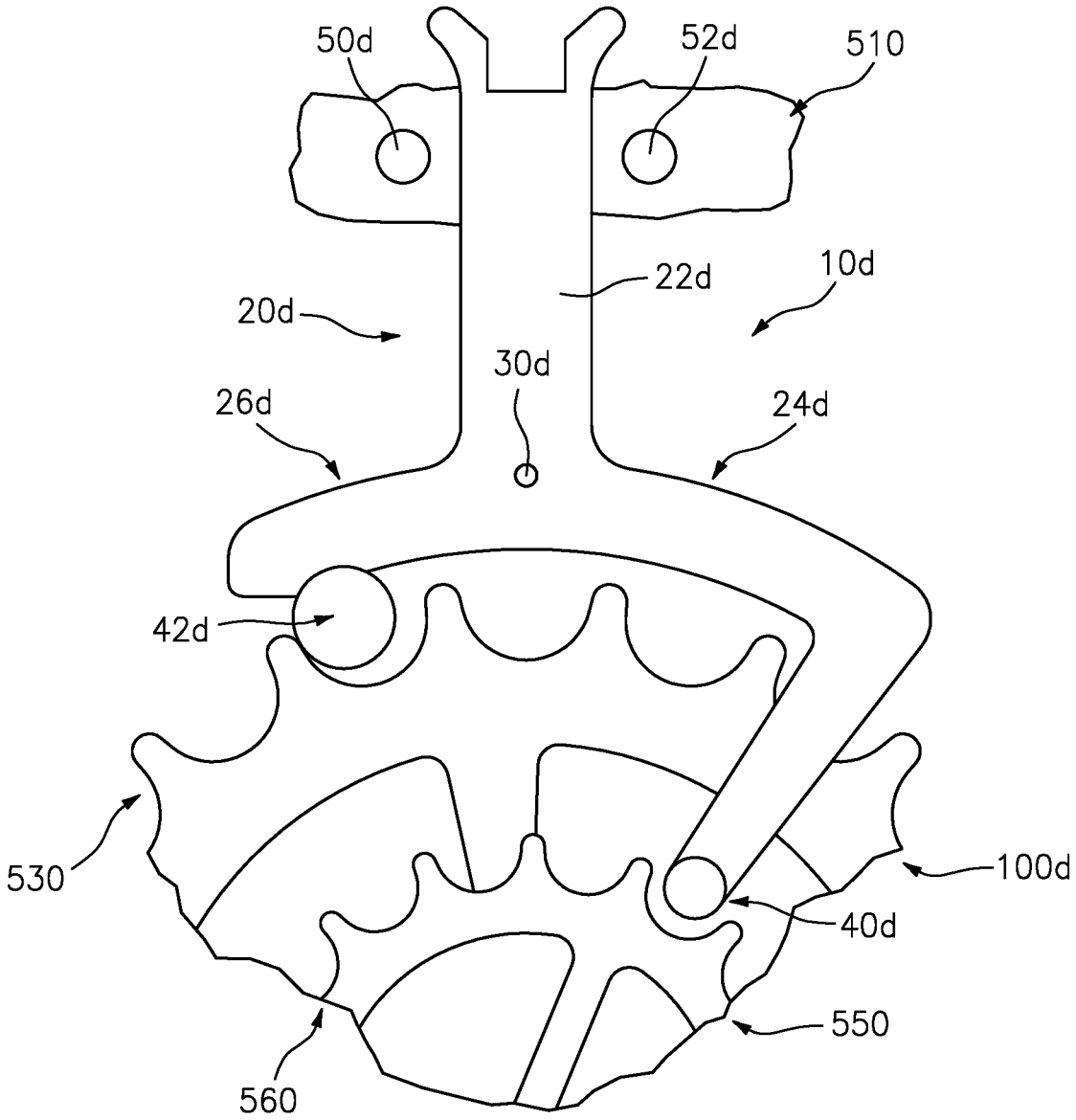
FIG. 5 is a schematic side view of an alternative escapement mechanism according to the present invention.

An alternative escapement mechanism 10*d* according to the present invention, FIG. 5, has two co-axial escapement wheels 100*d* and 550 plus a lever 20*d* having a shaft 22*d* and asymmetric forks 24*d*, 26*d*. Follower jewels 40*d*, 42*d* are mounted on forks 24*d*, 26*d*, respectively, and have different sizes relative to each other in some constructions. In this construction, limiter elements 50*d*, 52*d* are banking pins mounted on a support structure 510 such as a plate which also secures an axle rotatably connected to pivot 30*d*.

Cam elements 530 and 560 preferably are lobes that are uniformly distributed about the periphery of each of the escape wheels 100*d* and 550, respectively. The second escape wheel 550 has a smaller diameter than that of the escape wheel 100*d*. In one embodiment, the first plurality of cam elements 530 slidably contacts and drives the at least one follower element 42*d* on fork 26*d* of the lever 20*d*, and the second escape wheel 550, disposed coaxially with the first escape wheel 100*d*, defines the second plurality of cam elements 560, each cam element of the second plurality of cam elements 560 defining a leading cam surface suitable to slidably contact and drive the at least one rounded follower element 40*d* on the other fork 24*d*. Each cam element lacks a locking surface where contact is made with the follower elements 40*d* or 42*d*. The at least a first plurality of cam lobes 530 and the second plurality of cam lobes 560 are spaced at a second predetermined distance from each other, with the first distance between the at least two follow elements being a multiple of the second predetermined distance.

Although specific features of the present invention are shown in some drawings and not in others, this is for convenience only, as each feature may be combined with any or all of the other features in accordance with the invention. While there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature.

It is the intention, therefore, to be limited only as indicated by the scope of the claims appended hereto. Other embodiments will occur to those skilled in the art after reviewing the present disclosure and are within the following claims.

What is claimed is:

1. An escapement mechanism comprising:

a dual-forked lever having a pivot suitable for movement of the lever between a first pivot limit and a second pivot limit, and at least two rounded follower elements spaced from the pivot and spaced at a first predetermined distance from each other, with at least one follower element mounted on each fork of the lever and each follower element lacking a locking face, and at least one escape wheel having an outer periphery defining at least a first plurality of cam elements, each cam element defining a leading cam surface suitable to slidably contact and drive the rounded follower elements, and each cam element lacks a locking surface where contact is made with the follower elements;

wherein the first plurality of cam elements slidably contacts and drives the at least one follower element on one of the two forks of the lever, and further including a second escape wheel, disposed coaxially with the first escape wheel, wherein the second escape wheel defines a second plurality of cam elements, each cam element of the second plurality of cam elements defining a leading cam surface suitable to slidably contact and drive the at least one rounded follower element on the other of the two forks, and each cam element lacks a locking surface where contact is made with the follower elements.

2. The escapement mechanism of claim 1 wherein each of the cam elements is a rounded lobe.

3. The escapement mechanism of claim 1 further including at least two limiter elements, with one of the at least two limiter elements being fixed on one pivot side of the lever to establish the first pivot limit and the other of the at least two limiter elements being fixed on another side of the lever to establish the second pivot limit, the at least two limiter elements limiting rotation of the lever about its pivot.

4. The escapement mechanism of claim 3 wherein the limiter elements are banking pins mounted on a support structure.

5. The escapement mechanism of claim 1 wherein the at least a first plurality of cam lobes are arcuately-spaced curved elements, each of which defines leading and trailing cam surfaces.

6. The escapement mechanism of claim 1 wherein the at least a first plurality of cam elements are rounded lobes that are evenly spaced from each other about the periphery of the at least one escape wheel to be suitable to isochronally and slidably contact and drive the rounded follower elements.

7. The escapement mechanism of claim 1 wherein the at least a first plurality of cam lobes are each spaced at a second predetermined distance from each other, with the first predetermined distance being a multiple of the second predetermined distance.

8. The escapement mechanism of claim 1 wherein each fork carries at least one jewel as the at least one follower element, and the forks are symmetrical to each other.

9. The escapement mechanism of claim 1 wherein each fork carries at least one jewel as the at least one follower element, and the forks are asymmetrical to each other.

10. The escapement mechanism of claim 1 wherein the at least a first plurality of cam elements and the second plurality of cam elements are spaced at a second predetermined distance from each other, with the first distance between the at least two follow elements being a multiple of the second predetermined distance.

11. The escapement mechanism of claim 1 wherein one of the first and second escape wheels has a smaller diameter than the other of the escape wheels.

12. The escapement mechanism of claim 1 wherein the at least two follower elements differ in at least one dimension from each other.

13. The escapement mechanism of claim 1 wherein the lever transfers drive power to a time-keeping assembly.

14. The escapement mechanism of claim 1 together with a mechanical linkage including a first gear train suitable to drive the at least a first escape wheel.

15. A method of driving a time-keeping assembly, comprising:

selecting an escapement mechanism including (i) a dual-forked lever having a pivot suitable for movement of the lever between a first pivot limit and a second pivot limit, and at least two rounded follower elements spaced from the pivot and spaced at a first predetermined distance from each other, with at least one follower element mounted on each fork of the lever and each follower element lacking a locking face, and (ii) at least one escape wheel having an outer periphery defining at least a first plurality of cam elements, each cam element defining a leading cam surface suitable to slidably contact and drive the rounded follower elements, and each cam element lacks a locking surface where contact is made with the follower elements;

wherein the first plurality of cam elements slidably contacts and drives the at least one follower element on one of the two forks of the lever, and further including a second escape wheel, disposed coaxially with the first escape wheel, wherein the second escape wheel defines a second plurality of cam elements, each cam element of the second plurality of cam elements defining a leading cam surface suitable to slidably contact and drive the at least one rounded follower element on the other of the two forks, and each cam element lacks a locking surface where contact is made with the follower elements;

providing power to drive the at least one escape wheel continuously in one rotational direction; and transferring power from the at least one escape wheel to the lever to move the lever between the first pivot limit and the second pivot limit and thereby drive the time-keeping assembly.

* * * * *